US010657875B2

(12) United States Patent
Chung et al.

(10) Patent No.: US 10,657,875 B2
(45) Date of Patent: May 19, 2020

(54) DISPLAY DRIVING DEVICE AND A DISPLAY SYSTEM INCLUDING THE SAME

(71) Applicant: SAMSUNG ELECTRONICS CO., LTD., Suwon-si, Gyeonggi-do (KR)

(72) Inventors: Kyung-Hoon Chung, Hwaseong-si (KR); Won Sik Kang, Seoul (KR); Jae Sung Kang, Yongin-si (KR); Hyeok Chul Kwon, Hwaseong-si (KR); Si Woo Kim, Suwon-si (KR); Su Hyun Yun, Hwaseong-si (KR); Sang Kyu Lee, Yongin-si (KR); Ji Hyun Lee, Seoul (KR); Seng-Sub Chun, Hwaseong-si (KR); Jong Han Choi, Hwaseong-si (KR)

(73) Assignee: SAMSUNG ELECTRONICS CO., LTD., Suwon-si, Gyeonggi-Do (KR)

( * ) Notice: Subject to any disclaimer, the term of this patent is extended or adjusted under 35 U.S.C. 154(b) by 12 days.

(21) Appl. No.: 16/034,649

(22) Filed: Jul. 13, 2018

(65) Prior Publication Data

US 2019/0147790 A1 May 16, 2019

(30) Foreign Application Priority Data

Nov. 15, 2017 (KR) ..... 10-2017-0152211

(51) Int. Cl.
*G09G 3/20* (2006.01)

(52) U.S. Cl.
CPC ... *G09G 3/2092* (2013.01); *G09G 2310/0291* (2013.01); *G09G 2330/04* (2013.01); *G09G 2330/12* (2013.01)

(58) Field of Classification Search
CPC ..... G09G 2310/0291; G09G 2330/04; G09G 2330/12; G09G 3/2092
USPC ..... 345/208, 211, 213
See application file for complete search history.

(56) References Cited

U.S. PATENT DOCUMENTS

| | | | | |
|---|---|---|---|---|
| 7,706,114 | B2 | 4/2010 | Huang et al. | |
| 8,020,049 | B2 | 9/2011 | Asuncion et al. | |
| 8,681,458 | B2 | 3/2014 | Robb et al. | |
| 9,001,478 | B2 | 4/2015 | Ker et al. | |
| 9,390,670 | B2 | 7/2016 | Lee et al. | |
| 9,608,429 | B2 | 3/2017 | Welty | |
| 2006/0227126 | A1* | 10/2006 | Kawagoshi | G09G 3/3648 345/211 |

(Continued)

FOREIGN PATENT DOCUMENTS

KR 10-2006-0009636 2/2006

*Primary Examiner* — Tony O Davis
(74) *Attorney, Agent, or Firm* — F. Chau & Associates, LLC

(57) ABSTRACT

A display driving device including: a gate driver configured to provide a first gate selection signal to a first gate line of a display panel to select the first gate line; a source driver configured to provide an image signal corresponding to the first gate line to a source line; an Electrostatic Discharge (ESD) detection circuit configured to receive a power supply voltage, determine whether there is an ESD in the power supply voltage and, when the ESD is detected, generate a first detection signal; and a controller configured to receive the first detection signal to generate a masking signal, wherein the gate driver is configured to receive the masking signal and not provide a second gate selection signal to select a second gate line.

18 Claims, 16 Drawing Sheets

(56) References Cited

U.S. PATENT DOCUMENTS

| | | | | |
|---|---|---|---|---|
| 2010/0201899 | A1 | 8/2010 | Yamamoto | |
| 2012/0280966 | A1 | 11/2012 | Chen et al. | |
| 2015/0206492 | A1* | 7/2015 | Lee | G09G 3/3648 345/208 |
| 2015/0280415 | A1 | 10/2015 | Welty | |
| 2017/0039936 | A1* | 2/2017 | Byun | G09G 3/3233 |
| 2019/0147790 | A1* | 5/2019 | Chung | G09G 3/2092 345/213 |

* cited by examiner

DISPLAY DRIVING DEVICE AND A DISPLAY SYSTEM INCLUDING THE SAME

CROSS-REFERENCE TO RELATED APPLICATION

This application claims priority under 35 U.S.C. § 119 to Korean Patent Application No. 10-2017-0152211 filed on Nov. 15, 2017 in the Korean Intellectual Property Office, the disclosure of which is incorporated by reference herein in its entirety.

TECHNICAL FIELD

The present inventive concept relates to a display driving device and a display system including the same.

DISCUSSION OF THE RELATED ART

Flat panel displays such as a liquid crystal display (LCD) and an organic light emitting display (OLED) are widely used.

To maintain uniform output quality when Electrostatic Discharge (ESD) or Electrical Fast Transient/Burst (EFT/B) occurs in an output circuit of the flat panel display, a method of detecting and responding to ESD or EFT/B is used.

SUMMARY

According to an exemplary embodiment of the present inventive concept, a display driving device is provided that includes a gate driver configured to provide a first gate selection signal to a first gate line of a display panel to select the first gate line; a source driver configured to provide an image signal corresponding to the first gate line to a source line; an Electrostatic Discharge (ESD) detection circuit configured to receive a power supply voltage, determine whether there is an ESD in the power supply voltage and, when the ESD is detected, generate a first detection signal; and a controller configured to receive the first detection signal to generate a masking signal, wherein the gate driver is configured to receive the masking signal and not provide a second gate selection signal to select a second gate line.

According to an exemplary embodiment of the present inventive concept, there is provided a display driving device that includes an input unit which is connected to a power supply line, the input unit configured to provide a first control signal of a first level to a first node when a positive ESD is applied to the power supply line, and generate the first control signal of a second level to the first node when a negative ESD is applied to the power supply line; a detecting unit configured to be turned on by the first control signal of the first level or the second level and provide a second control signal to a second node; a reset unit configured to reset a voltage level of the second node to a ground voltage with a reset signal; and a buffer unit configured to buffer an output of the second node to output a detection signal.

According to an exemplary embodiment of the inventive concept, there is provided a display driving device that includes a gate driver configured to provide gate selection signals to gate lines of a display panel, wherein a first gate selection signal is used to select a first gate line; a source driver configured to provide an image signal corresponding to the first gate line to a source line; an interface configured to receive a clock signal and a data signal provided by a processor, generate a detection signal in response to an ESD generated in the clock signal or the data signal, and provide the detection signal to the controller, and a controller configured to generate a masking signal in response to the detection signal, wherein the gate driver stops providing the gate selection signals in response to the masking signal.

According to an exemplary embodiment of the inventive concept, there is provided a display system that includes a processor; a display panel including a plurality of pixels; and a display driving device configured to receive graphics data from the processor to provide an image signal to the display panel, wherein the display driving device comprises: a gate driver configured to provide gate selection signals to gate lines of the display panel, a source driver configured to provide image signals corresponding to the gate lines to source lines, an ESD detection circuit configured to receive a power supply voltage and detect an ESD generated in the power supply voltage to generate a first detection signal, an interface configured to receive a clock signal and a data signal from the processor and generate a second detection signal when ESD occurs in the clock signal or the data signal, and a controller configured to generate a masking signal in response to the first detection signal or the second detection signal and to provide the masking signal to the gate driver, wherein the gate driver is configured to receive the masking signal and stop providing the gate selection signals.

According to an exemplary embodiment of the inventive concept, there is provided a display driving device that includes a gate driver configured to sequentially provide a plurality of gate line selection signals to a display panel; an ESD detection circuit configured to detect an ESD in a power supply voltage and, in response to the detected ESD, generate a first detection signal; and a controller configured to generate a masking signal in response to the first detection signal, wherein the gate driver stops providing the gate line selection signals at a first gate line in response to the first detection signal and restarts providing the gate line selection signals at a second gate line when the masking signal is stopped.

BRIEF DESCRIPTION OF THE DRAWINGS

The above and other features of the present inventive concept will become more apparent by describing in detail exemplary embodiments thereof with reference to the attached drawings, in which.

DETAILED DESCRIPTION OF THE EMBODIMENTS

Hereinafter, a display driving device and a display system including the same according to an exemplary embodiment of the present inventive concept will be described with reference to FIGS. 1 to 16.

Figure 1:
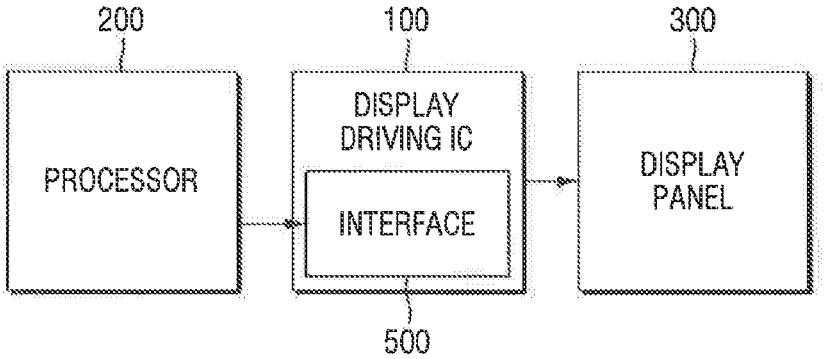
FIG. 1 is a block diagram of a display system including a display driving device according to an exemplary embodiment of the present inventive concept.

FIG. 1 is a block diagram of a display system including a display driving device according to an exemplary embodiment of the present inventive concept.

Referring to FIG. 1, a display system according to an exemplary embodiment of the present inventive concept may include a display driving device (or display driving IC) 100, a processor 200, and a display panel 300.

In an exemplary embodiment of the inventive concept, the processor 200 may include, but is not limited to, a Central Processor Unit (CPU), an Application Processor (AP), a Graphic Processing Unit (GPU), and the like.

The display driving device 100 may be connected with the processor 200 via an interface 500.

The interface 500 may operate, for example, in accordance with a Mobile Industry Processor Interface (MIPI) standard which is a standard defined by the MIPI alliance. For example, the interface 500 may be an interface defined by a MIPI D-PHY specification.

However, the present inventive concept is not limited thereto, and the interface 500 may include any one of a Small Computer System Interface (SCSI), a Peripheral Component Interconnect (PCI) express, an Advanced Technology Attachment (ATA), a PATA (Parallel ATA), a Serial ATA (SATA), a SAS (Serial Attached SCSI), and a Non Volatile Memory Express (NVMe) type interface.

Hereinafter, the description will be provided on the assumption that the interface 500 is a MIPI interface.

The display panel 300 may include any one of, for example, a liquid crystal display (LCD), a light emitting diode (LED) display, an organic LED (OLED) display, an active-matrix OLED (AMOLED) display, an Electrochromic Display (ECD), and a Plasma Display Panel (PDP). However, the present inventive concept is not limited thereto.

The display driving device 100 may transmit and receive a clock or data to and from the processor 200 via the interface 500. The display driving device 100 may provide a display driving signal to the display panel 300. This will be described in more detail with reference to FIG. 2.

Figure 2:
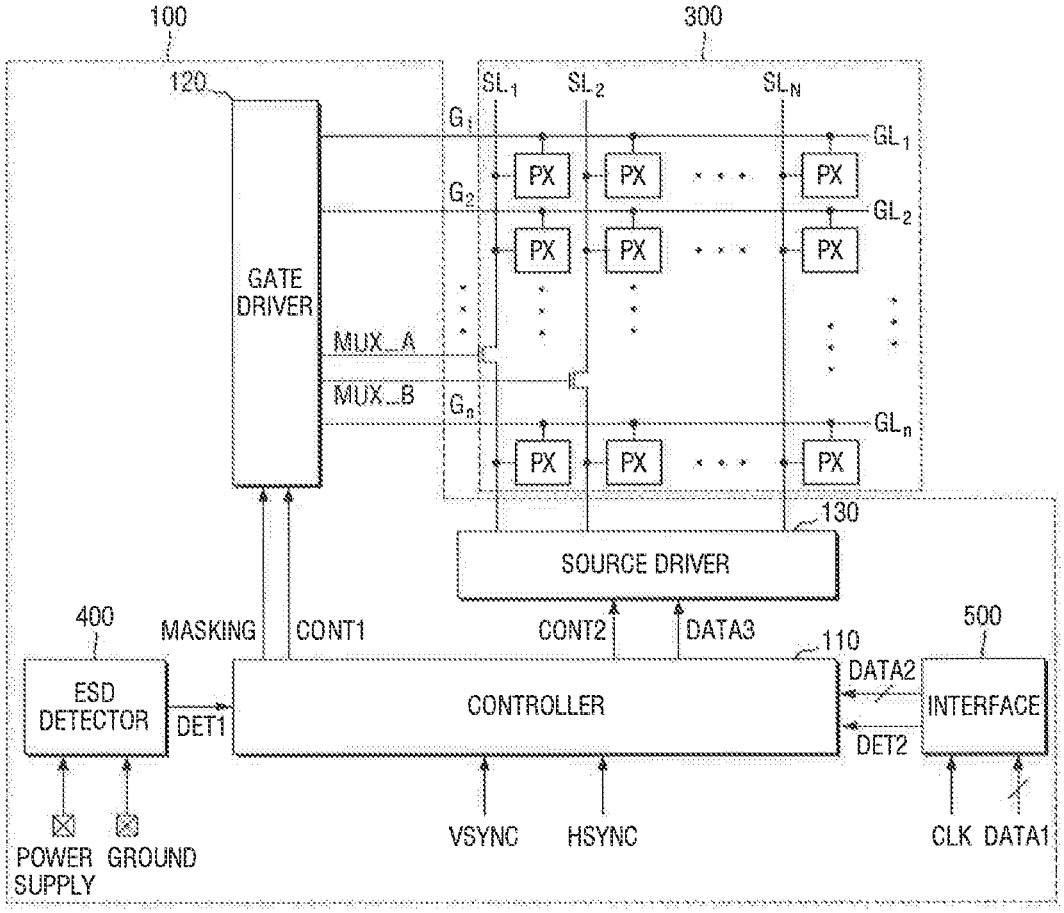
FIG. 2 is a block diagram of the display driving device of FIG. 1 and a display panel according to an exemplary embodiment of the present inventive concept.

FIG. 2 is a block diagram of the display driving device and the display panel of FIG. 1 according to an exemplary embodiment of the present inventive concept.

Referring to FIG. 2, the display driving device 100 may include a controller 110, a gate driver 120, a source driver 130, an ESD detecting unit (or ESD detector) 400, and an interface 500.

The controller 110 may receive the clock and data from the processor 200 via the interface 500. For example, the processor 200 may provide a first data signal (DATA1) and a clock signal (CLK), which are graphics data for driving the display panel 300, to the interface 500. The interface 500 may receive the first data signal (DATA1) and the clock signal (CLK) and may provide a second data signal (DATA2) to the controller 110.

The controller 110 may provide a signal for driving the display panel 300 to the gate driver 120 and the source driver 130, using a vertical synchronization signal (VSYNC) and a horizontal synchronization signal (HSYNC), and the second data signal (DATA2). The VSYNC and HSYNC signals may be provided from outside the display driving device 100 and the second data signal (DATA2) may be provided from the interface 500.

For example, the controller 110 may divide the second data signal (DATA2) on a frame basis in response to the vertical synchronization signal (VSYNC). The controller 110 may divide the second data signal (DATA2) on a line basis in the frame in response to the horizontal synchronization signal (HSYNC) to generate the third data signal (DATA3).

The controller 110 may provide a gate control signal (CONT1) to the gate driver 120. The gate control signal (CONT1) is a signal for controlling the gate driver 120. The gate driver 120 may sequentially select gate lines (GL1 to GLn) in response to the gate control signal (CONT1).

In addition, the controller 110 may provide a source control signal (CONT2) and the third data signal (DATA3) to the source driver 130. The source driver 130 may process the third data signal (DATA3) in response to the source control signal (CONT2) to generate a plurality of driving voltages, and may supply the generated driving voltages to the display panel 300 through a plurality of source lines (SL1 to SLn).

The display panel 300 may include the plurality of gate lines (GL1 to GLn) and the plurality of source lines (SL1 to SLn). The display panel 300 may include a plurality of pixels (PX) disposed at positions in which the gate lines (GL1 to GLn) and the source lines (SL1 to SLn) intersect with each other.

In an exemplary embodiment of the inventive concept, the gate driver 120 may provide the display panel 300 with multiplex signals (MUX_A, MUX_B) for selecting at least one of the plurality of source lines (SL1 to SLn). For example, among the plurality of source lines (SL1 to SLn), a source line (SL1) selected by the multiplex signal MUX_A is connected to one driver circuit included in the source driver 130, and the source line (SL2) selected by the multiplex signal MUX_B may be connected to another driver circuit in the source driver 130.

In an exemplary embodiment of the inventive concept, the display driving device 100 may further include a memory. The display driving device 100 stores the graphics data received from the processor 200 in the memory. In other words, the display driving device 100 may use the memory as a kind of buffer, and may update the memory with new graphics data each time new graphics data is received from the processor 200.

When, however, ESD detection signals (DET1, DET2) are generated by ESD detection, the display driving device 100 does not store and update the graphics data received from the processor 200 in the memory. Therefore, the display driving device 100 may hold previously received graphics data in the memory.

In the display driving device according to an exemplary embodiment of the present inventive concept, the controller 110 may receive the ESD detection signals (DET1, DET2) indicating whether or not to perform ESD detection with the ESD detecting unit 400 and the interface 500.

In an exemplary embodiment of the present inventive concept, the ESD detecting unit 400 may detect an excessive voltage change, for example, instantaneously occurring in a power supply voltage (VDD) or the like. The excessive voltage change that occurs in the power supply voltage (VDD) may be caused by ESD, but it may be due to EFT/B (Electrical Fast Transient/Burst). Herein, the term 'ESD' may refer to elements that may cause an instantaneously excessive change in voltage/current level from inside or outside the display drive, e.g., both ESD and EFT/B.

When the controller 110 is provided with the ESD detection signals (first DET1, second DET2), a masking signal (MASKING) may be generated and provided to the gate driver 120 and the source driver 130. The ESD detection operation of the ESD detecting unit 400 and the interface 500 will be described later, and the operation of the controller 110 and the gate driver 120 at the time of ESD detection will be described first.

Figure 3:
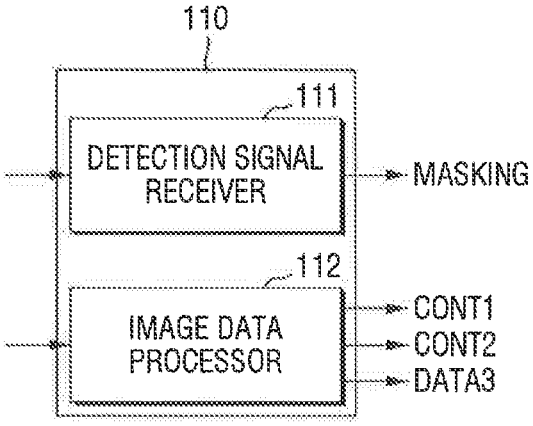
FIG. 3 is a block diagram of a controller included in the display driving device of FIG. 1 according to an exemplary embodiment of the present inventive concept.

FIG. 3 is a block diagram of a controller included in the display driving device of FIG. 2 according to an exemplary embodiment of the present inventive concept.

Referring to FIG. 3, the controller 110 may include a detection signal receiver 111 and an image data processor 112.

The detection signal receiver 111 receives the first and second detection signals (DET1, DET2) and may generate the masking signal (MASKING) in response to the first and second detection signals (DET1, DET2). For example, when at least one of the first detection signal (DET1) or the second detection signal (DET2) is enabled, the masking signal (MASKING) is enabled and may be provided to the gate driver 120 and the source driver 130.

The image data processor 112 may divide the second data signal (DATA2) on the frame basis according to the vertical synchronization signal (VSYNC), and may divide the second data signal (DATA2) on the gate line basis according to the horizontal synchronization signal (HSYNC) to generate the third data signal (DATA3).

When the gate driver 120 is provided with an enabled masking signal (MASKING) signal, the gate driver 120 may interrupt the provision of gate line selection signals (G1 to Gn) to the gate lines (GL1 to GLn). For example, the gate driver 120 may prevent the gate line selection signals (G1 to Gn) from being provided to the gate lines (GL1 to GLn). This will be explained in more detail with reference to FIG. 4.

Figure 4:
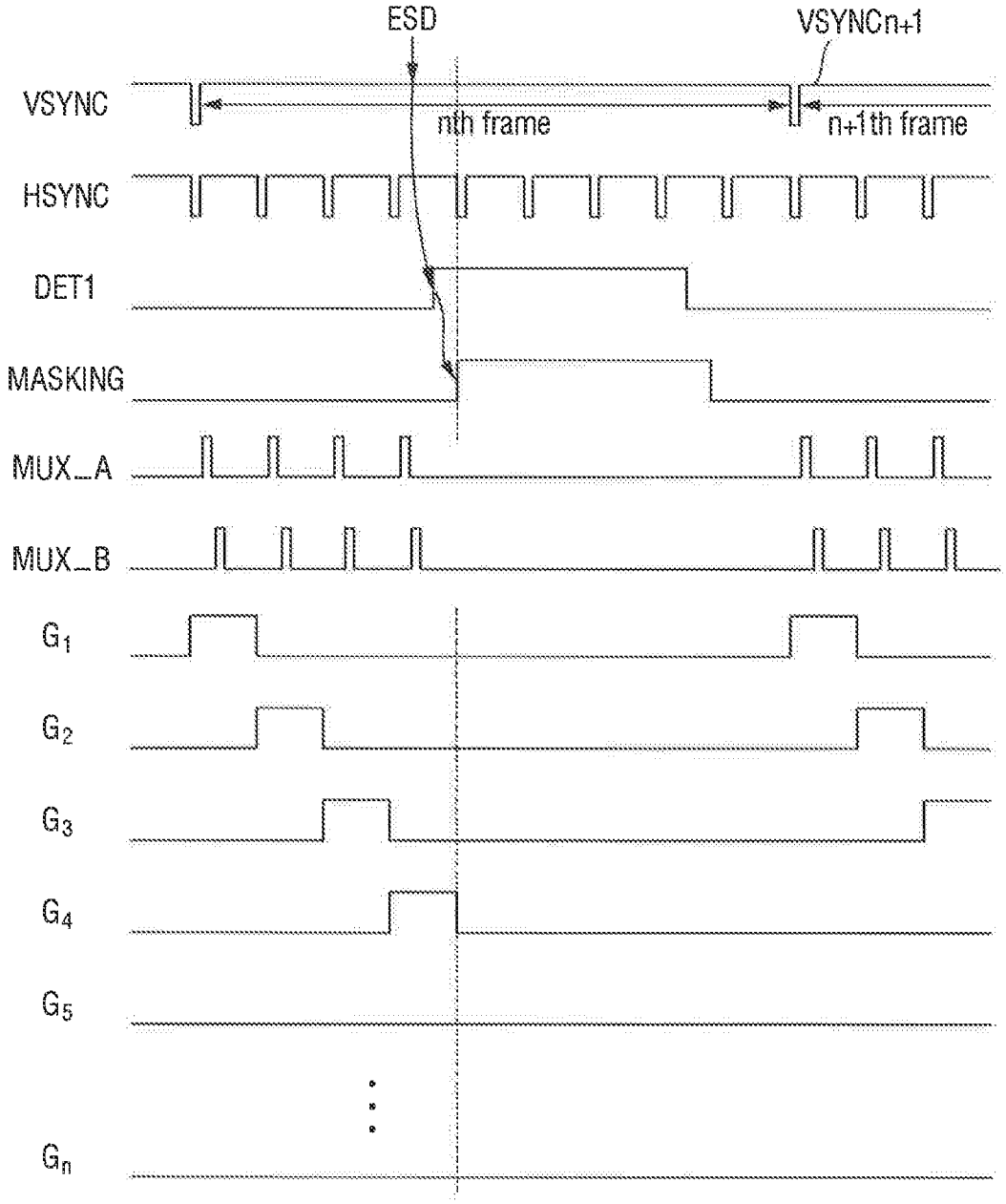
FIG. 4 is a timing chart illustrating the operation of the display driving device of FIG. 1 according to an exemplary embodiment of the present inventive concept.

FIG. 4 is a timing chart illustrating the operation of the display driving device of FIG. 1 according to an exemplary embodiment of the present inventive concept.

Referring to FIG. 4, frames of an image displayed by the display panel 300 are divided by the vertical synchronization signal (VSYNC), and horizontal lines of the image may be divided and processed by the horizontal synchronization signal (HSYNC).

The horizontal synchronization signal (HSYNC) and the gate line selection signals (G1 to Gn) may be synchronized. In other words, during one horizontal synchronization signal (HSYNC) period, one gate line selection signal (G1 to Gn) may be enabled and provided to the gate lines (GL1 to GLn) of the display panel 300.

The gate driver 120 may sequentially provide the gate line selection signals (G1 to Gn) synchronized with the horizontal synchronization signal (HSYNC) to the gate lines (GL1 to GLn) to select the gate lines (GL1 to GLn). As illustrated in FIG. 4, the first gate line (GL1), the second gate line (GL2), the third gate line (GL3) and the fourth gate line (GL4) are selected by the first gate line selection signal (G1), the second gate line selection signal (G2), the third gate line selection signal (G3) and the fourth gate line selection signal (G4) sequentially provided by the gate driver 120. In this case, the transistors included in the pixels PX connected to the respective gate lines (GL1 to GL4) may be turned on.

A case where ESD is detected by the ESD detecting unit 400 will now be discussed. As illustrated in FIG. 4, the ESD detecting unit 400 detects the ESD and provides the first detection signal (DET1) to the controller 110. The controller 110 receives the first detection signal (DET1), generates a masking signal (MASKING) in response to the first detection signal (DET1), and supplies the masking signal (MASKING) to the gate driver 120 and the source driver 130. For example, the controller 110 may provide a masking signal (MASKING) of a logic high level to the gate driver 120 in response to the first detection signal (DET1) of a logic high level.

The gate driver 120 receiving the masking signal (MASKING) of a logic high level may interrupt the provision of a gate line selection signal to a gate line. In other words, although the gate driver 120 last provided the fourth gate line selection signal (G4) to the fourth gate line (GL4), the gate driver 120 may not provide a fifth gate line selection signal (G5) to the fifth gate line (GL5) after receiving the enabled masking signal (MASKING).

Further, the gate driver 120 may not provide the gate line selection signals to the gate lines (GL 6 to GLn).

The gate driver 120 may receive the masking signal (MASKING) of the logic high level and may also interrupt the provision of the multiplex signals (MUX_A, MUX_B) to the display panel 300. In other words, after receiving the masking signal (MASKING) of the high level, the gate driver 120 may not output the first and second multiplex signals MUX_A and MUX_B.

Thereafter, the first detection signal (DET1) provided from the ESD detecting unit 400 transitions to a logic low level, and the controller 110 may provide the masking signal (MASKING) of a logic low level to the gate driver 120 and the source driver 130.

In an exemplary embodiment of the present inventive concept, after the logic level of the masking signal (MASKING) provided by the gate driver 120 is changed to a logic low, the gate driver 120 may not immediately resume the provision of a gate line selection signal. For example, the gate driver 120 may not output a gate line selection until the next vertical synchronization signal (VSYNCn+1) of a next frame (n+1th) is enabled.

At the same time that the vertical synchronization signal (VSYNCn+1) is enabled, the gate driver 120 starts the provision of the first gate line selection signal (G1) to the first gate line (GL1) and so forth. Therefore, the gate driver 120 may sequentially provide the gate line selection signals (GL1 to GLn) to the gate lines (G1 to Gn).

The gate driver 120 may also receive the masking signal (MASKING) of a logic low level and restart the provision of the multiplex signals (MUX_A, MUX_B) to the display panel 300.

Figure 5:
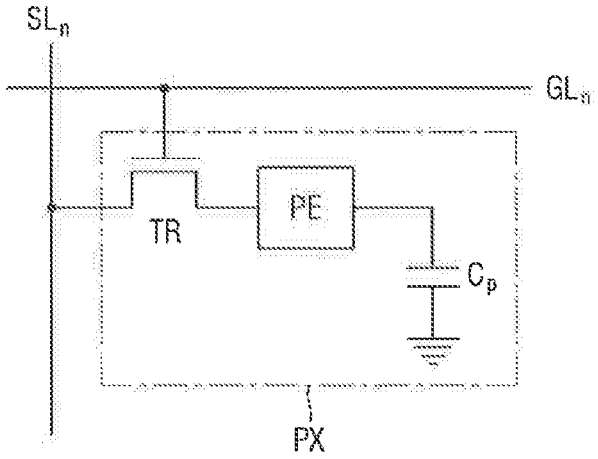
FIG. 5 is a circuit diagram of pixels included in the display panel of FIG. 2, according to an exemplary embodiment of the inventive concept.

FIG. 5 is a circuit diagram of the pixels PX included in the display panel of FIG. 2, according to an exemplary embodiment of the inventive concept.

Referring to FIG. 5, the pixel (PX) may include a transistor (TR), a pixel electrode (PE) and a pixel capacitor (Cp).

A gate terminal of the transistor (TR) is connected to the n-th gate line (GLn), and a source terminal of the transistor (TR) may be connected to the n-th source line (SLn). The transistor (TR) is turned on by the n-th gate line selection signal (Gn), a driving voltage is supplied by the n-th source line signal Sn, and an operating voltage may be supplied to the pixel electrode (PE).

A pixel capacitor (Cp) may be connected to each pixel electrode (PE) of the pixels PX. The pixel capacitor (Cp) may be charged by the operating voltage provided to the pixel electrode (PE). By holding the charge, the pixel capacitor (Cp) may maintain the voltage of both ends of the pixel electrode (PE) for a certain period of time.

According to the operation of the gate driver 120 described above referring to FIG. 4, after ESD detection is performed by the ESD detecting unit 400, provision of the gate line selection signals (G1 to Gn) from the gate driver 120 may be stopped. As a result, the transistor (TR) included in each pixel (PX) is not turned on and the transistor (TR) may not provide an operating voltage to the pixel electrode (PE). However, due to the charge previously maintained by the pixel capacitor (Cp), the operating voltage of the pixel electrode (PE) may be maintained.

In other words, the charge already charged in the pixel capacitor (Cp) by the source line signal Sn provided in the n-th frame may maintain the operating voltage of the pixel electrode (PE) in the n+1-th frame. Therefore, when the transistor (TR) is not turned on in the n+1-th frame by the detection of the ESD, since the operating voltage of the pixel electrode (PE) is maintained from the n-th frame, the pixel (PX) may continue to display the same image from the n-th frame. Therefore, the image displayed by the pixel (PX) is prevented from being turned off, even when ESD is detected.

Figure 6:
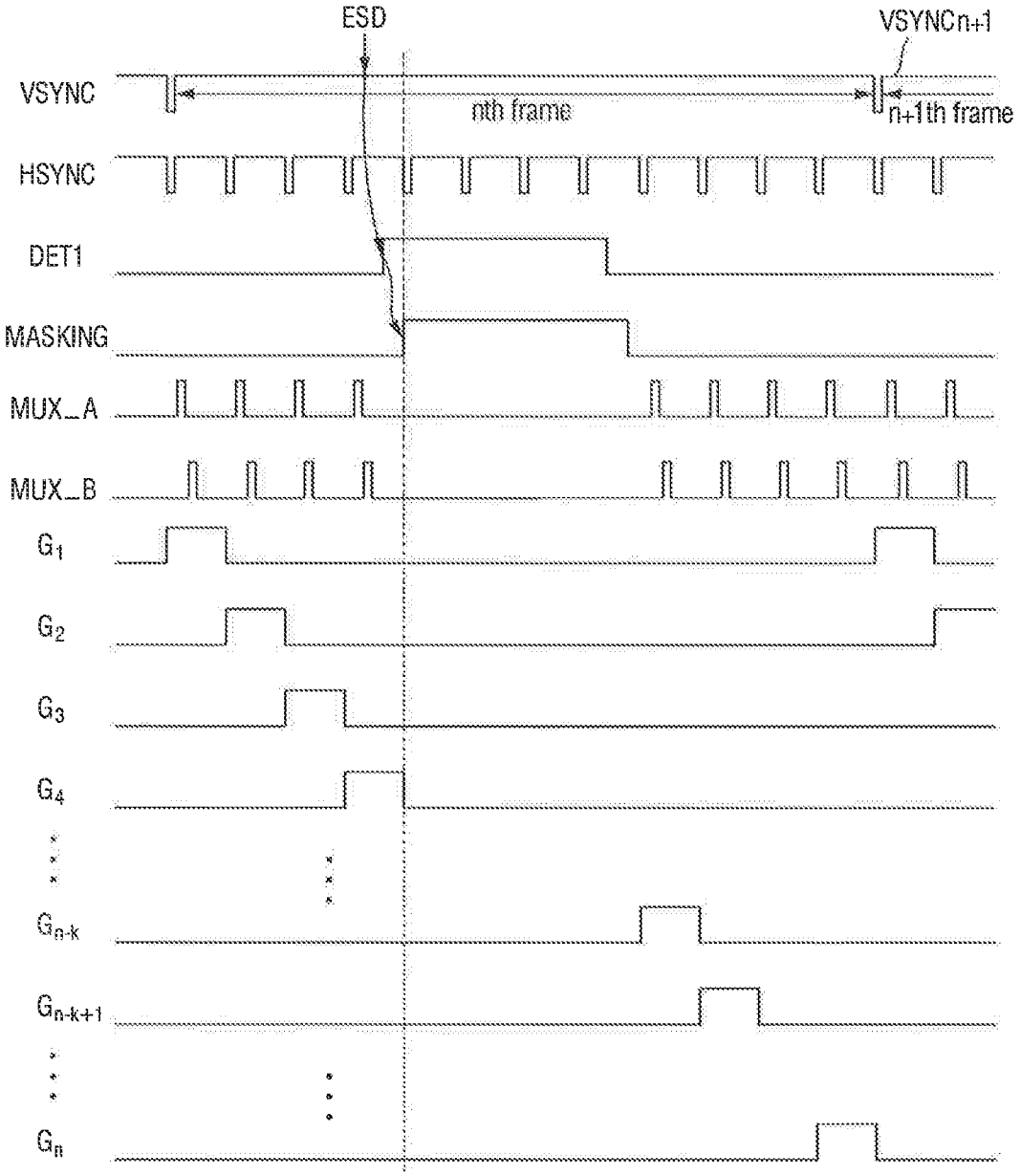
FIG. 6 is a timing chart illustrating the operation of the display driving device of FIG. 1 according to an exemplary embodiment of the present inventive concept.

FIG. 6 is a timing chart for explaining the operation of the display driving device of FIG. 1 according to an exemplary embodiment of the present inventive concept.

Referring to FIG. 6, the display driving device according to an exemplary embodiment of the present inventive concept may differ from the operation of the display driving device described above with reference to FIG. 4.

For example, when the masking signal (MASKING) is transitioned to the low level during the period of n-frame, the gate driver 120 may restart provision of a gate line selection signal to a gate line, without waiting for the start of the next frame (n+1-th frame) by the vertical synchronization signal (VSYNCn+1).

For example, after the provision of the gate line selection signal is interrupted by the masking signal (MASKING) of the high level, the internal counter of the gate driver 120 may count the horizontal synchronization signal (HSYNC). For example, when the masking signal (MASKING) is disabled, at the same time (or when) the horizontal synchronization signal (HSYNC) of the n-k-th line is provided to the gate driver 120, the gate driver 120 may provide the n-k-th gate line selection signal (GLn-k) to the n-k-th gate line (GLn-k). As a result, the driving of the pixels of the n-k-th line may be restarted.

Although the above description has been made in which the controller 100 generates the masking signal (MASKING) in response to the first detection signal (DET1), and then, the gate driver 120 interrupts the provision of the gate line selection signals (G1 to Gn), it is to be understood that the controller 100 can generate the masking signal (MASKING) in response to the second detection signal (DET2).

Generation of the first detection signal (DET1) or the second detection signal (DET2) by the ESD detecting unit 400 or the interface 500 to generate the masking signal (MASKING) as described above will now be described.

Figure 7:
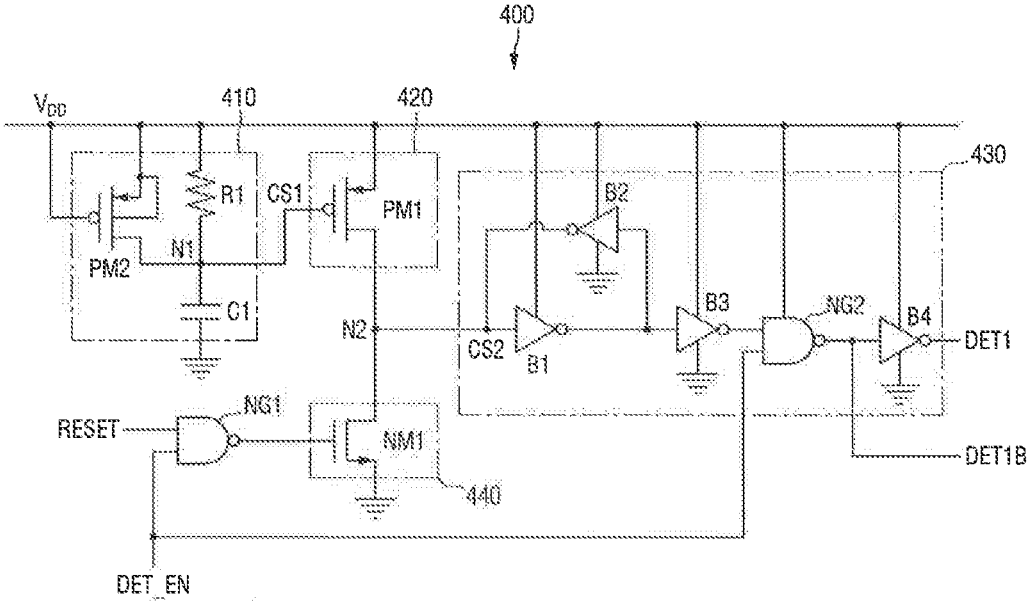
FIG. 7 is a circuit diagram of an Electrostatic Discharge (ESD) detection circuit included in the display driving device of FIG. 1 according to an exemplary embodiment of the present inventive concept.

FIG. 7 is a circuit diagram of an ESD detection circuit included in the display driving device of FIG. 1 according to an exemplary embodiment of the present inventive concept.

Referring to FIG. 7, the ESD detecting unit 400 may include an input unit 410, a detecting unit 420, a buffer unit 430, and a reset unit 440.

The input unit 410 may provide a first control signal (CS1) to a first node (N1). For example, the input unit 410 may include a transistor (PM2), one end of which is connected to the first node (N1), a resistor (R1) and a capacitor (C1).

The transistor (PM2) may be a PMOS transistor in which a source terminal and a gate terminal are connected to a power supply voltage (VDD). In addition, since the transistor's (PM2) body is also connected to the power supply voltage (VDD), the transistor (PM2) may be a diode connection type transistor. Therefore, when a potential difference occurs between the first node (N1) and the power supply voltage (VDD), a forward bias is generated between the first node (N1) and the power supply voltage (VDD), and discharge to the power supply voltage (VDD) may occur.

In an exemplary embodiment of the present inventive concept, the input unit 410 may also include a diode in which an anode is connected to the first node (N1) and a cathode is connected to the power supply voltage (VDD). The diode may take the place of the transistor (PM2).

In FIG. 7, although a configuration in which the transistor (PM2) is connected to the power supply voltage (VDD) and one end of the capacitor (C1) is connected to the ground voltage, is illustrated, the present inventive concept is not limited thereto. For example, the gate terminal and the source terminal of the transistor (PM2) are connected to the first voltage, and one end of the capacitor (C1) may be connected to a second voltage lower than the first voltage. In this case, the ESD detection device 400 may determine whether the ESD detection is to be performed on the basis of the relative voltage change between the first voltage and the second voltage.

As shown in FIG. 7, for convenience of the explanation, the ESD detecting unit 400 is connected between the power supply voltage and the ground voltage.

As described above, the input unit 410 may provide the first control signal (CS1) to the first node (N1). The voltage level of the first control signal (CS1) provided by the input unit 410 to the first node (N1) may be different, depending on the potential of the ESD generated at the power supply voltage (VDD).

For example, when a positive ESD occurs in the power supply voltage (VDD), the first control signal (CS1) may have a first voltage level, and when a negative ESD occurs in the power supply voltage (VDD), the first control signal (CS1) may have a second voltage level. In addition, when ESD does not occur in the power supply voltage (VDD), the first control signal (CS1) may have a third voltage level.

The detecting unit 420 may include a PMOS transistor (PM1) gated by the voltage level of the first node (N1), e.g., the first control signal (CS1). The detecting unit 420 may be turned on by the first control signal (CS1) and provide a second control signal (CS2) to a second node (N2). For example, the transistor (PM1) of the detecting unit (420) is turned on by the first control signal (CS1) of the first voltage level or the first control signal (CS1) of the second voltage level, and may provide the second control signal (CS2) to the second node (N2).

The reset unit 440 may provide the second control signal (CS2) of the ground voltage level to the second node (N2) in response to a reset signal (RESET) and a detection enable signal (DET_EN) provided to a NAND gate (NG1). The reset unit 440 may include an NMOS transistor (NM1) which is switched by the output of the NAND gate (NG1).

The buffer unit 430 may receive and buffer the second control signal (CS2) to provide a first detection signal (DET1) and a complementary signal first detection signal (DET1B).

In FIG. 7, the buffer unit 430 is illustrated to include first and second buffers (B1, B2) whose respective output terminals are connected to their respective input terminals, a third buffer (B3) which receives the output of the first buffer (B1), a NAND gate (NG2) which receives the output of the third buffer (B3) and the enable signal (DET_EN), and a fourth buffer (B4) which receives the output of the NAND gate (NG2). It is to be understood, however, that the buffer unit 430 is not limited to thereto.

The operation of the ESD detecting unit 400 will be described in more detail with reference to FIGS. 8 to 10.

Figure 8:
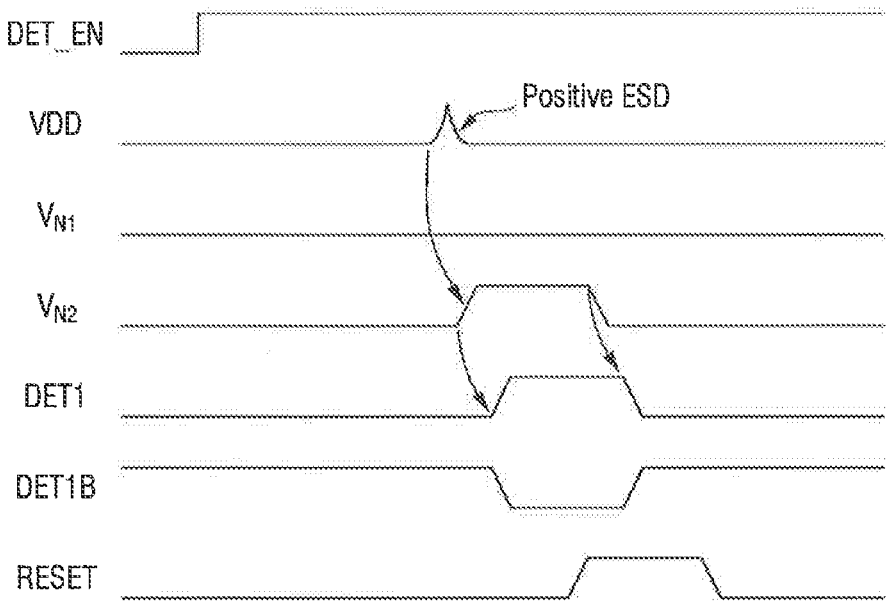
FIG. 8 is a timing chart for explaining the operation of the ESD detection circuit of FIG. 7, according to an exemplary embodiment of the inventive concept.

FIG. 8 is a timing chart for explaining the operation of the ESD detection circuit of FIG. 7, according to an exemplary embodiment of the inventive concept.

Referring to FIGS. 7 and 8 together, a case where the positive ESD occurs at the power supply voltage (VDD) is illustrated.

When the detection enable signal (DET_EN) is applied at the logic high level and the second control signal (CS2) is applied via the second node (N2), the value that is output through the buffers (B1, B3) passes through the NAND gate (NG2) and may be provided as the first detection signal (DET1).

Subsequently, a positive ESD occurs in the power supply voltage (VDD). When the positive ESD occurs in the power supply voltage (VDD), the voltage level (VN1) of the first node (N1) rises slower than the rising speed of the voltage level of the power supply voltage (VDD) by the time constant of the resistor (R1) and the capacitor (C1). As a result, the transistor (PM1) of the detecting unit (420) is turned on, and the voltage level (VN2) of the second node (N2) rises to the first level.

The voltage level (VN2) of the second node (N2) rising to the first level is input to the buffer unit 430 in the form of the second control signal (CS2), and is output as the first detection signal (DET1), and the complementary first detection signal (DET1B). Thereafter, by the application of the reset signal (RESET), the voltage level (VN2) of the second node (N2) and the first detection signal (DET1) may be reset. In other words, the voltage level (VN2) of the second node (N2) and the first detection signal (DET1) may each go to the level they were at prior to rising.

With the above process, the ESD detecting unit 400 may detect the positive ESD applied to the power supply voltage (VDD).

Figure 9:
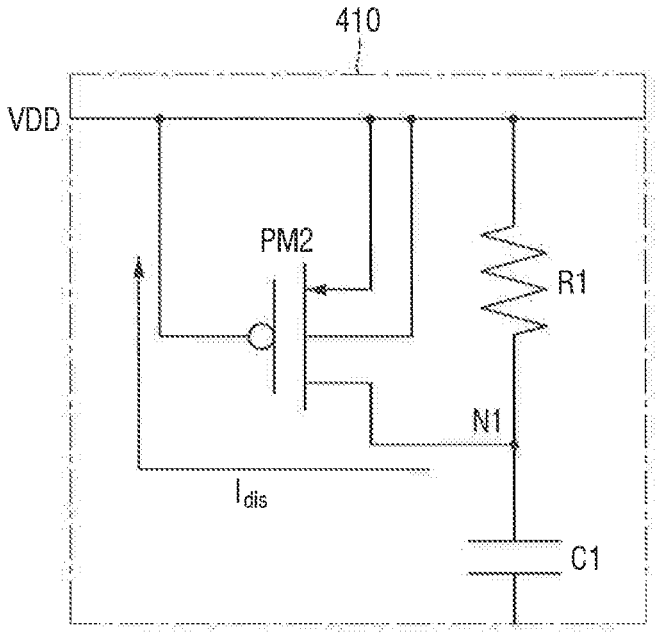
FIG. 9 is a circuit diagram for explaining the operation of the ESD detection circuit of FIG. 7, according to an exemplary embodiment of the inventive concept.

FIG. 9 is a circuit diagram for explaining the operation of the ESD detecting circuit of FIG. 7, according to an exemplary embodiment of the inventive concept. FIG. 10 is a timing chart for explaining the operation of the display driving device according to an exemplary embodiment of the present inventive concept.

Figure 10:
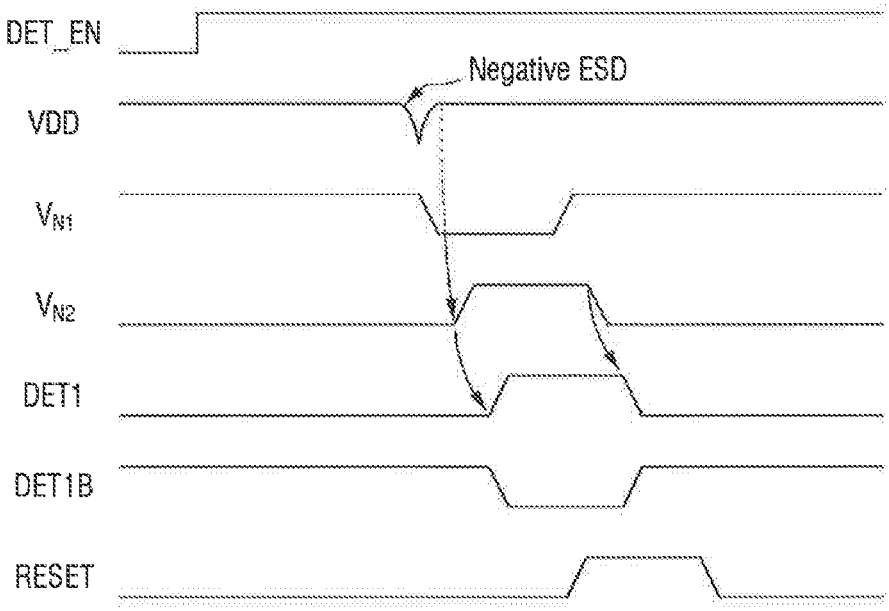
FIG. 10 is a timing chart for explaining the operation of the display driving device of FIG. 1 according to an exemplary embodiment of the present inventive concept.

Referring to FIGS. 7, 9, and 10, the operation of the ESD detecting unit 400 will be described when a negative ESD is applied to the power supply voltage (VDD).

When a negative ESD occurs in the power supply voltage (VDD), as mentioned above, the voltage level (VN1) of the first node (N1) falls slower than the falling speed of the voltage level of the power supply voltage (VDD), by the time constant of the resistor (R1) and the capacitor (C1). As a result, a forward bias is generated between the first node (N1) and the power supply voltage (VDD), a discharge current (Idis) flows from the first node (N1) to the power supply voltage (VDD), and the voltage level (VN1) of the first node (N1) falls.

Thereafter, the power supply voltage (VDD) recovers from the negative ESD and has reverts back to its original voltage level. However, the voltage level (VN1) of the first node (N1) rises slower than the rising speed of the voltage level of the power supply voltage (VDD) by the time constant of the resistor (R1) and the capacitor (C1). As a result, the transistor (PM1) of the detecting unit (420) is turned on, and the voltage level (VN2) of the second node (N2) rises to the second level.

The voltage level (VN2) of the second node (N2) rising to the second level is input to the buffer unit 430 in the form of the second control signal (CS2), and is output as the first detection signal (DET1), and the complementary first detection signal (DET1B). Thereafter, by the application of the reset signal (RESET), the voltage level (VN2) of the second node (N2) and the first detection signal (DET1) may be reset.

In an exemplary embodiment of the inventive concept, the second level may be lower than the first level. In other words, the voltage level (VN2) of the second node (N2) at the time of detecting the positive ESD may be lower than the voltage level (VN2) of the second node (N2) at the time of detecting the negative ESD.

Figure 11:
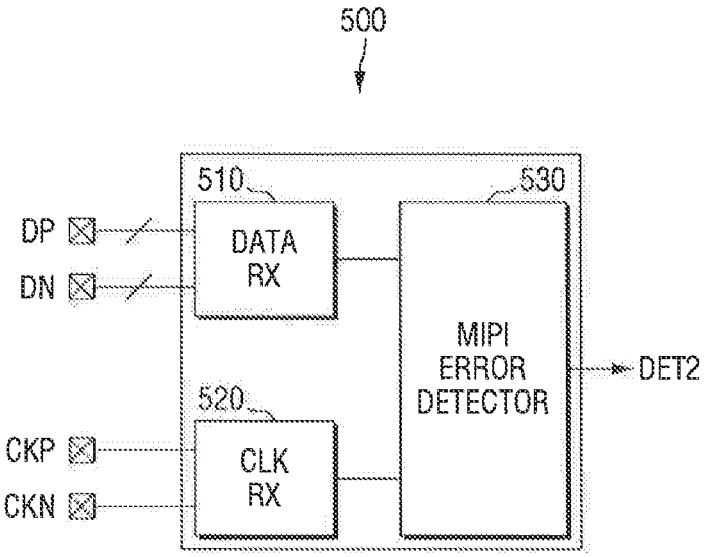
FIG. 11 is a block diagram of an interface circuit included in the display driving device of FIG. 1 according to an exemplary embodiment of the present inventive concept.

FIG. 11 is a block diagram of an interface 500 included in the display driving device of FIG. 1 according to an exemplary embodiment of the present inventive concept.

Referring to FIG. 11, the interface (or interface circuit) 500 may include a data receiver 510, a clock receiver 520, and an MIPI error detecting unit (or MIPI detector) 530.

The data receiver 510 may receive the data (DATA1) provided from the processor 200. The data (DATA1) provided from the processor 200 may be provided from two interconnected lines (DP, DN).

The data receiver 510 may operate in a differential high-speed (HS) mode which simultaneously uses the two interconnection lines (DP, DN), and a single-ended low power (LP) mode which separately operates in each of the interconnection lines (DP, DN).

In the HS mode, the two interconnection lines (DP, DN) have, for example, a low voltage swing of about 200 mV, whereas in the LP mode, the two interconnection lines (DP, DN) may have a high voltage swing of, for example, about 1.2 V. In an exemplary embodiment of the inventive concept, the HS mode is used for high-speed data transmission, and the LP mode is used for command transmission, but the inventive concept is not limited thereto.

The clock receiver 510 may receive the clock provided from the processor 200. As with the data (DATA1) provided from the processor 200, the processor 200 may provide the clock in the form of two interconnected clocks (CKP, CKN).

The MIPI error detecting unit 530 may determine the occurrence of ESD of the data lane or clock lane on the basis of the timing between the provided data (DP, DN) and the clocks (CKP, CKN).

Figure 12:
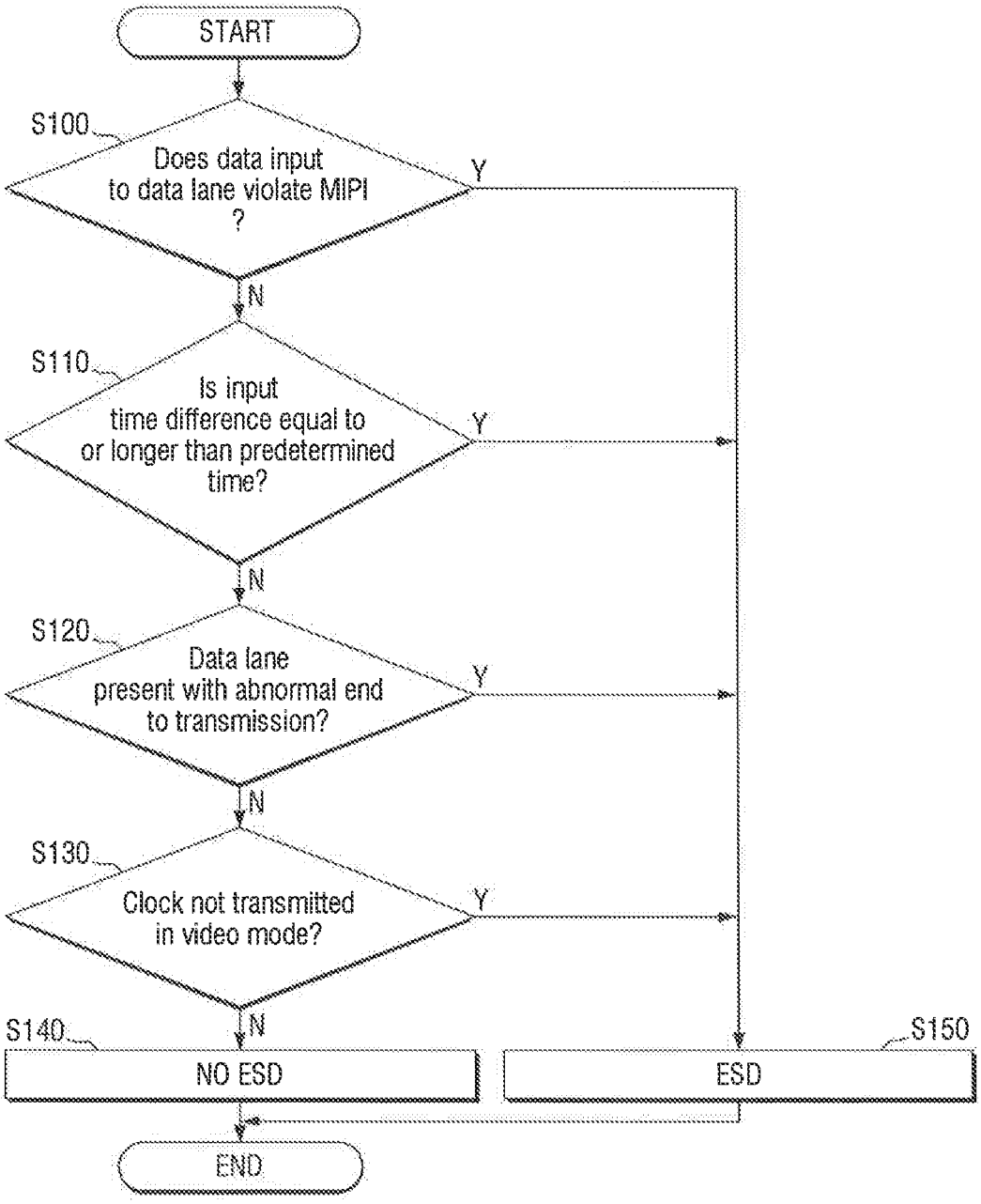
FIG. 12 is a flow chart for explaining the operation of the display driving device of FIG. 1 according to an exemplary embodiment of the present inventive concept.

FIG. 12 is a flowchart for explaining the operation of the display driving device according to an exemplary embodiment of the present inventive concept.

Referring to FIG. 12, the interface 500 detects whether or not the data (DP, DN) which are input to the data lane violates the MIPI Link Protocol (S100), and compares the input time difference between the clock and the data to detect whether the input time difference is equal to or longer than a predetermined tine (S110). Next, the interface 500 detects the presence or absence of a data lane in which the transmission is abnormally ended among a plurality of data lanes (S120), and detects a case where the clock is not transmitted in the display-on section of video mode of the MIPI interface (S130). Finally, the interface 500 may determine whether the ESD detection signal is generated (S150) or not generated (S140).

First, in FIG. 12, the MIPI error detecting unit 530 detects whether or not the data (DP, DN) which are input to the data lane violate the MIPI Link Protocol (S100).

Detection whether the data violates the MIPI Link Protocol may involve determining whether the transmission of the clock and data is completed in accordance with the protocol defined in the MIPI protocol. This may include, for example, determining whether there is an occurrence of an Invalid Transmission Length Error, an SoT Error, an SoT Sync Error, an error correction code (ECC) Single Bit/Multi Bit Error, or a Checksum Error. However, the inventive concept is not limited thereto.

When the error occurs, the interface 500 may consider that ESD occurs in the data (DP, DN) input to the data lane or the clocks (CKP, CKN) input to the clock lane, and thus, provide the second detection signal (DET2) to the controller 100.

Subsequently, the input time difference between the clock and the data is compared, and it is determined whether or not the input time difference is equal to or longer than a predetermined time (S110). This will be described in more detail with reference to FIGS. 13 and 14.

Figure 13:
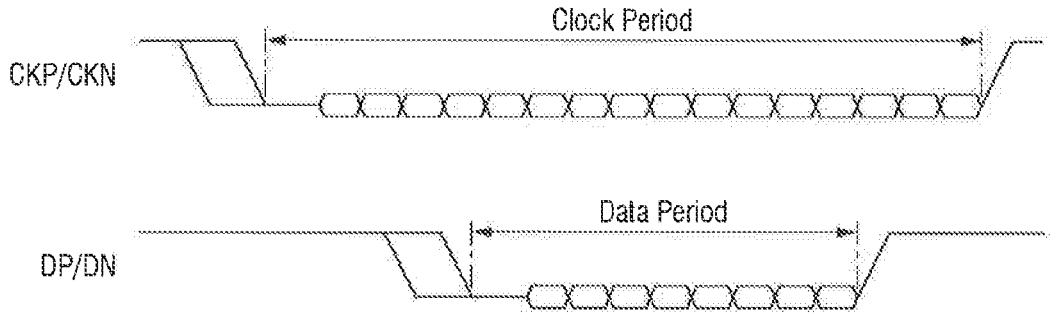
FIG. 13 is a timing chart for explaining the operation of an interface circuit included in the display driving device of FIG. 1 according to an exemplary embodiment of the present inventive concept.

FIG. 13 is a timing chart illustrating the operation of an interface circuit included in the display driving device of FIG. 1 according to an exemplary embodiment of the present inventive concept.

Referring to FIG. 13, the transmission period (Clock Period) at which the two interconnected clocks (CKP, CKN) received by the interface 500 are transmitted in a high speed mode (HS mode) is shown.

Additionally, the transmission period (Data Period) at which the two interconnected data (DP, DN) received by the interface 500 are transmitted in the high speed mode is shown.

FIG. 13 illustrates a timing chart of transmission of the clock and data in compliance with the MIPI standard.

Figure 14:
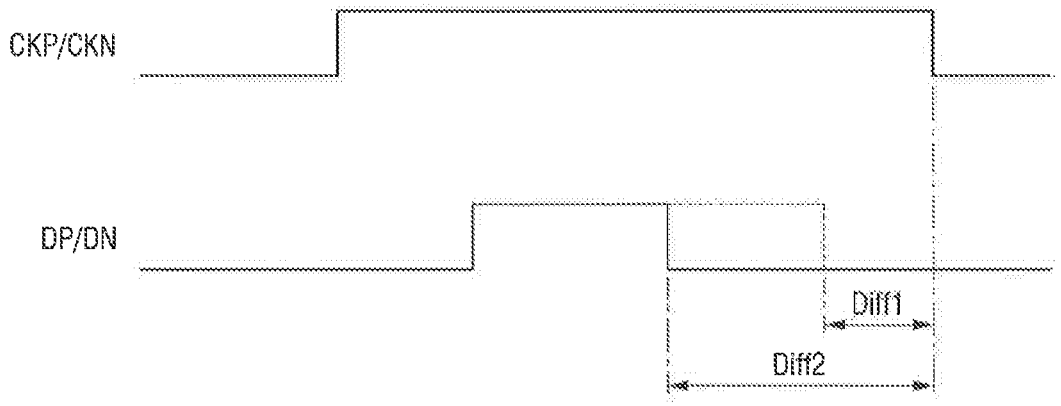
FIG. 14 is a timing chart for explaining the operation of the interface circuit included in the display driving device of FIG. 1 according to an exemplary embodiment of the present inventive concept.

FIG. 14 is a timing chart for explaining the operation of the interface circuit included in the display driving device of FIG. 1 according to an exemplary embodiment of the present inventive concept. FIG. 14 illustrates a timing chart illustrating the clock period and the data cycle in the high speed mode (HS mode) previously illustrated in FIG. 13.

Referring to FIG. 14, the MIPI error detecting unit 530 compares the end time of the clock period with the end time of the data period in the high speed mode. For example, when a predetermined interval between the end point of the clock period and the end point of the data period is set as a first interval (Diff1), and an interval between the end point of the clock period detected by the MIPI error detecting unit 530 and the end cycle of the data period is set as a second interval (Diff2), the MIPI error detecting unit 530 may check whether or not the first interval (Diff1) and the second interval (Diff2) coincide with each other. In other words, if the second interval (Diff2) is larger than the first interval (Diff1), the interface 500 may consider the ESD to have occurred in the data lane. Therefore, the interface 500 may provide the second detection signal (DET2) to the controller 100.

Referring again to FIG. 12, the presence or absence of a data lane in which the transmission is abnormally ended among a plurality of data lanes is detected (S120). This will also be explained in more detail using FIG. 15.

Figure 15:
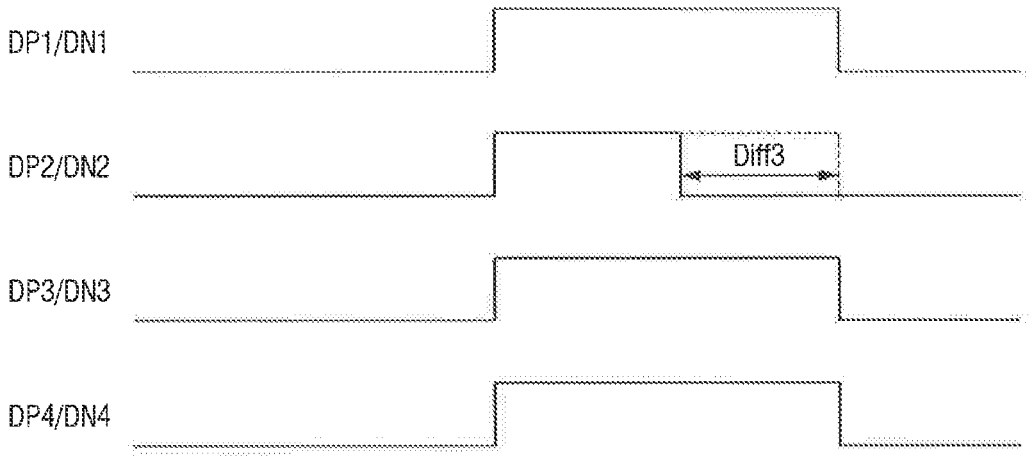
FIG. 15 is a timing chart for explaining the operation of the interface circuit included in the display driving device of FIG. 1 according to an exemplary embodiment of the present inventive concept.

FIG. 15 is a timing chart for explaining the operation of the interface circuit included in the display driving device of FIG. 1 according to an exemplary embodiment of the present inventive concept.

Referring to FIG. 15, two interconnected data (DP, DN) may be transmitted in parallel with a plurality of data. FIG. 15 illustrates an example in which each of two interconnected data (DP, DN), for example, 4-bit parallel data, is transmitted. For example, the two interconnected data (DP, DN) may be transmitted in parallel by 4-bit signals of the first data to the fourth data (DP1 to DP4, DN1 to DN4).

The MIPI error detecting unit 530 checks whether or not the transmission of the first data to the fourth data (DP1 to DP4, DN1 to DN4) provided from the processor 100 is completed simultaneously. When the transmission of the first data to the fourth data (DP1 to DP4, DN1 to DN4) is completed simultaneously, the MIPI error detecting unit 530 considers that ESD has not occurred in the data lane.

On the other hand, if there is data in which the transmission is abnormally and quickly completed among the first data to the fourth data (DP1 to DP4, DN1 to DN4), the MIPI error detecting unit 530 considers that ESD has occurred in the data lane. In this case, the MIPI error detecting unit 530 may provide the second detection signal (DET2) to the controller 110. For example, as shown in FIG. 15, the MIPI error detecting unit 530 recognizes that the transmission of the second data (DP2/DN2) is completed earlier than other three data by the third interval (Diff3), and thus, may determine that ESD is present. In an exemplary embodiment of the inventive concept, the MIPI error detecting unit 530 may provide the second detection signal (DET2) to the controller 110, only when the third interval (Diff3) is larger than the predetermined interval.

Referring again to FIG. 12, the interface 500 may detect whether ESD occurs by recognizing the case where no clock is transmitted in the display-on section of the video mode (S130). This will also be explained in further detail using FIG. 16.

Figure 16:
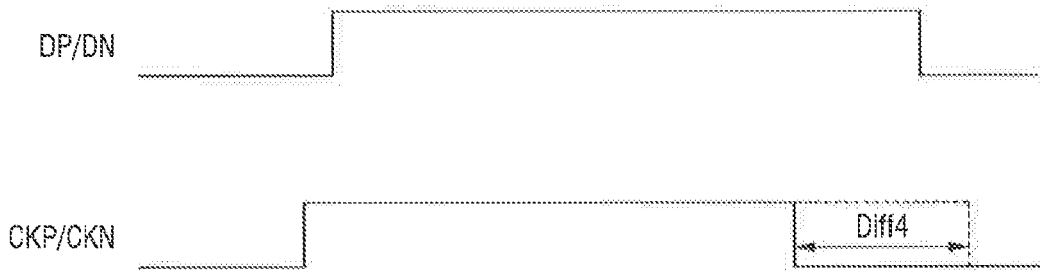
FIG. 16 is a timing chart for explaining the operation of the interface circuit included in the display driving device of FIG. 1 according to an exemplary embodiment of the present inventive concept.

FIG. 16 is a timing chart for explaining the operation of the interface circuit included in the display driving device of FIG. 1 according to an exemplary embodiment of the present inventive concept.

Referring to FIG. 16, transmission in the video mode which is a burst mode of continuous data transmission in the MIPI protocol will be described as an example. In the video mode, the clocks (CKP, CKN) may be continuously provided to the interface 500 irrespective of the clock period. The clock receiver 520 receives the continuous clocks (CKP, CKN) provided from the processor 100, and may provide them to the MIPI error detecting unit 530.

In the video mode, while the clocks (CKP, CKN) are continuously provided to the interface 500, the processor 200 also continuously transmits the data (DP, DN) to the interface 500. In order for these video modes to continue without interruption, the clocks (CKP, CKN) are provided to the interface 500 continue without interruption.

However, as illustrated in FIG. 16, when the clocks (CKP, CKN) are abnormally interrupted in the video mode, the MIPI error detecting unit 530 considers that ESD occurs in the clock lane. In this case, the MIPI error detecting unit 530 determines that the transmission of the clocks (CKP/CKN) is completed earlier than the data (DP, DN) by a fourth interval (Diff4), and thus, may generate and provide the second detection signal (DET2) to the controller 110.

In summary, the interface 500 generates the second detection signal (DET2) and may provide the second detection signal (DET2) to the controller 110 when the detection condition is satisfied by at least one of the above conditions. The controller 110 may generate a masking signal (MASKING) signal on the basis of the second detection signal (DET2).

The steps (S100 to S130) executed by the interface 500 may be executed separately or simultaneously, and the steps (S100 to S130) may be executed in a different order from those described above, or some steps may be omitted.

While the present inventive concept has been particularly illustrated and described with reference to exemplary embodiments thereof, it will be understood by those of ordinary skill in the art that various changes in form and detail may be made therein without departing from the spirit and scope of the present inventive concept as defined by the following claims.

What is claimed is:

1. A display driving device, comprising:

a gate driver configured to provide a first gate selection signal to a first gate line of a display panel to select the first gate line;

a source driver configured to provide an image signal corresponding to the first gate line to a source line;

an Electrostatic Discharge (ESD) detection circuit configured to receive a power supply voltage, determine whether there is an ESD in the power supply voltage and, when the ESD is detected, generate a first detection signal; and a controller configured to receive the first detection signal to generate a masking signal, wherein the gate driver is configured to receive the masking signal and not provide a second gate selection signal to select a second gate line, wherein the gate driver is configured to not provide the second gate selection signal during a first in which a first vertical synchronization signal is enabled, and when a second vertical synchronization signal is enabled, the gate driver is configured to provide the second ate selection signal.

2. The display driving device of claim 1, wherein the controller is configured to stop generating the masking signal when the first detection signal is not provided from the ESD detection circuit.

3. The display driving device of claim 2, wherein the gate driver is configured to provide the second gate selection signal when the masking signal is stopped.

4. The display driving device of claim 1, wherein the display panel includes a plurality of pixels, wherein a first pixel is arranged at a point where the first gate line and the source line intersect each other, a pixel capacitor is connected to the first pixel, and the pixel capacitor maintains an image signal voltage of a previous frame while the second gate selection signal is stopped.

5. The display driving device of claim 1, further comprising:

an interface which is configured to receive a clock signal and a data signal from a processor.

6. The display driving device of claim 5, wherein the interface is configured to communicate with the processor, using a Mobile Industry Processor Interface (MIPI) standard, a second detection signal is provided to the controller when ESD is detected in the clock signal or the data signal provided from the processor, and the controller is configured to generate the masking signal in response to the first detection signal and the second detection signal.

7. A display driving device, comprising:

an input unit which is connected to a power supply line, the input unit configured to provide a first control signal of a first level to a first node when a positive Electrostatic Discharge (ESD) is applied to the power supply line, and generate the first control signal of a second level to the first node when a negative ESD is applied to the power supply line;

a detecting unit configured to be turned on by the first control signal of the first level or the second level and provide a second control signal to a second node;

a reset unit configured to reset a voltage level of the second node to a ground voltage with a reset signal; and a buffer unit configured to buffer an output of the second node to output a detection signal, wherein the second level is a voltage level which is lower than a power supply voltage applied to the power supply line.

8. The display driving device of claim 7, wherein the input unit is configured to generate the first control signal of a third level when the positive or negative ESD does not occur in the power supply line, and the second level is lower than the third level.

9. The display driving device of claim 8, wherein the input unit includes a transistor having a gate and a source terminal connected to the power supply line.

10. The display driving device of claim 9, wherein the transistor is configured to discharge a voltage of the first node to the power supply voltage or less when the negative ESD is applied to the power supply line.

11. The display driving device of claim 8, wherein the input unit includes a diode that is forward bias-connected from the first node to the power supply line.

12. A display driving device, comprising:

a gate driver configured to provide gate selection signals to gate lines of a display panel, wherein a first gate selection signal is used to select a first gate line;

a source driver configured to provide an image signal corresponding to the first gate line to a source line;

an interface configured to receive a clock signal and a data signal provided by a processor, generate a detection signal in response to an Electrostatic Discharge (ESD) generated in the clock signal or the data signal, and output the detection signal; and a controller configured to generate a masking signal in response to the detection signal, wherein the gate driver stops providing the gate selection signals in response to the masking signal.

13. The display driving device of claim 12, wherein the interface communicates with the processor, using a Mobile Industry Processor Interface (MIPI) standard.

14. The display driving device of claim 13, wherein the interface is configured to generate the detection signal when the data signal violates a MIPI Link Protocol.

15. The display driving device of claim 13, wherein the interface is configured to generate the detection signal when transmission of the data signal is completed before transmission of the clock signal in a high-speed transmission mode.

16. The display driving device of claim 13, wherein the data signal includes a first data signal and a second data signal, and the interface is configured to generate the detection signal when transmission of the first data signal is completed before transmission of the second data signal in a data transmission mode.

17. The display driving device of claim 13, wherein the interface is configured to generate the detection signal when transmission of the clock signal is interrupted in a video mode.

18. The display driving device of claim 12, wherein the controller is configured to stop generating the masking signal when the detection signal is interrupted.

* * * * *